United States Patent [19]

Oakes

[11] Patent Number: 4,488,980

[45] Date of Patent: Dec. 18, 1984

[54] DETERGENT COMPOSITIONS

[75] Inventor: John Oakes, South Wirral, England

[73] Assignee: Lever Brothers Company, New York, N.Y.

[21] Appl. No.: 559,592

[22] Filed: Dec. 8, 1983

[30] Foreign Application Priority Data

Dec. 17, 1982 [GB] United Kingdom ..... 8236006

[51] Int. Cl.[3] ..... C11D 3/04; D06L 3/02

[52] U.S. Cl. ..... 252/99; 252/95; 252/133

[58] Field of Search ..... 252/99, 95

[56] References Cited

U.S. PATENT DOCUMENTS

| | | | |
|---|---|---|---|
| 3,156,654 | 11/1964 | Konecny et al. | 252/186.38 |
| 3,372,125 | 3/1968 | Hill et al. | 252/99 |
| 3,532,634 | 10/1970 | Woods | 252/186.4 |
| 4,119,557 | 10/1978 | Postlethwaite | 252/99 |

FOREIGN PATENT DOCUMENTS

| | | | |
|---|---|---|---|
| 843636 | 12/1976 | Belgium | 252/95 |
| 70079 | 3/1983 | European Pat. Off. | 252/95 |
| 82563 | 6/1983 | European Pat. Off. | 252/95 |
| 984459 | 2/1965 | United Kingdom | 252/95 |

*Primary Examiner*—Maria Parrish Tungol

*Attorney, Agent, or Firm*—Milton L. Honig; James J. Farrell

[57] ABSTRACT

Built detergent bleach compositions are disclosed comprising a surface-active agent, a peroxide compound bleach (e.g. sodium perborate), a manganese compound which delivers manganese (II) ions in aqueous solution (e.g. manganous sulphate or manganous chloride) and a builder mixture comprising a condensed phosphate and an alkalimetal orthophosphate in a weight ratio of from 10:1 to 1:60, preferably from 5:1 to 1:30. The composition is particularly effective for washing fabrics at low temperature, e.g. from 20°-60° C., but is also usable at higher temperatures.

5 Claims, No Drawings

DETERGENT COMPOSITIONS

This invention relates to detergent compositions comprising a peroxide compound bleach suitable for the bleaching and cleaning of fabrics. The peroxide compound bleach used herein includes hydrogen peroxide and hydrogen peroxide adducts, e.g. inorganic persalts, which liberate hydrogen peroxide in aqueous solutions such as the water-soluble perborates, percarbonates, perphosphates, persilicates and the like.

Detergent compositions comprising said peroxide compounds are known in the art. Since said peroxide compounds are relatively ineffective at lower temperatures, i.e. up to 70° C., these compositions have to be used at near boiling temperatures in order to achieve a satisfactory bleach.

Various proposals have been made to activate peroxide compounds so as to make them usable bleaches at lower temperatures. One proposed route is the use of so-called organic activators—usually organic compounds having one or more reactive acyl residues—which in solution react with the peroxide compound, e.g. sodium perborate, to form an organic peroxy-acid e.g. peroxyacetic acid, which is a more effective bleach at lower temperatures. Such bleach activators are described for example in a series of articles by Allan H. Gilbert in "Detergent Age", June 1967, pages 18–20, July 1967, August 1967, pages 26, 27 and 67.

Another approach is the use of heavy metal ions of the transition series which catalyse peroxide decomposition, together with a special type of chelating agent for said heavy metal. U.S. Pat. No. 3,156,654 discloses that only by a proper choice of the heavy metal and of the chelating agent, not only with respect to each other but also in regard of the adsorption power of the material to be bleached i.e. fabrics, relative to the complexing strength of the chelating agent, an improved bleaching can be obtained. The chelating agent, according to this U.S. patent, must be one which is not a stronger complexing agent for the heavy metal ions present than the material to be bleached is. No further concrete examples of metal/chelating agent combinations are given, except for cobalt and copper salts used in conjunction with pyridine carboxylic acid chelating agents, preferpreferably as a preformed complex.

U.S. Pat. No. 3,532,634 discloses bleaching compositions comprising a persalt, an organic activator and a transition metal, together with specially selected chelating agents. The transition metals applicable according to this U.S. patent have atomic numbers of from 24 to 29.

British Pat. No. 984,459 suggested the use of a copper salt in combination with a sequestering agent which is methylaminodiacetic acid, aminotriacetic acid or hydroxyethylaminodiacetic acid.

U.S. Pat. No. 4,119,557 suggested the use of a preformed ferric ion complex with a polycarboxyamine type chelating agent.

U.S. Pat. No. 3,372,125 discloses the use of metal-cyano complexes, particularly Fe-cyano complexes, in denture cleansing compositions comprising dipotassium persulphate, sodium perborate, sodium carbonate and trisodium phosphate.

Still the main problem with heavy metal catalysis is that the results are often inconsistent and/or unsatisfactory, particularly if used for washing fabrics at lower temperatures.

It is an object of the present invention to provide an improved detergent bleach composition which is effective at lower temperatures, e.g. from 20° to 60° C., without the use of peracids or organic activators forming peroxy acids as the bleaching species.

European patent application No. 82563 (published June 29, 1983) describes the use of manganese/carbonate mixtures.

It has now surprisingly been found that manganese has outstanding properties with respect to consistently improving the bleach performance of peroxide compounds at substantially all temperatures, e.g. from 20° to 95° C., particularly at lower temperatures, e.g. from 20° to 60° C., if used in the presence of a builder mixture comprising a condensed phosphate and an alkalimetal orthophosphate.

The manganese used according to the present invention can be derived from any manganese (II) salt, such as manganous sulphate and manganous chloride, or any other manganese compound which delivers manganese (II) ions in aqueous solution.

The condensed phosphate and the alkalimetal orthophosphate according to the invention should be present in a weight ratio of from 10:1 to 1:60. preferably from 5:1 to 1:30.

Accordingly the invention provides a built detergent bleach composition comprising a peroxide compound and a heavy metal compound, characterized in that it comprises a builder mixture comprising a condensed phosphate and an alkalimetal orthophosphate in a weight ratio of from 10:1 to 1:60, and a manganese compound which delivers manganese (II) ions in aqueous solution.

The optimum levels of manganese (II) ions - $Mn^{2+}$- in the wash/bleach solution are dependent upon the formulation in which the manganese as bleach catalyst is applied. In terms of parts per million (ppm) of manganese (II) ions in the wash/bleach solution a suitable range will generally be from 0.1 to 50 ppm, preferably from 0.5–25 ppm.

These correspond roughly to a manganese (II) metal content in a bleach or detergent composition of about 0.005–2.5% by weight, preferably from 0.025–1.0% by weight of the composition.

The level of peroxide compound bleach in the composition of the invention will normally be within the range of about 4 to 50% by weight, preferably from 10–35% by weight of the total composition.

A preferred peroxide compound is alkalimetal perborate, particularly sodium perborate, which may be in its tetrahydrate or lower hydrate form.

The condensed phosphates usable in the present invention include the alkalimetal triphosphates, the alkalimetal pyrophosphates and the alkalimetal hexametaphosphates, the sodium salts thereof being preferred. A preferred builder mixture is sodiumtriphosphate/sodiumorthophosphate.

The condensed phosphate and the alkalimetal orthophosphate may be used as the sole builders in the composition of the invention, or as desired in admixture with other principal or non-principal builders in minor amounts to the main builder mixture of the invention. As such can be named, for example, silicates, nitrilotriacetate, etc.

Consequently, the total amount of condensed phosphate and orthophosphate in the composition of the invention can be varied as desired for providing the required builder capacity of the composition with or without the presence of other builders.

In practice the composition of the invention may comprise from about 5 to 80% by weight, preferably 10–60% by weight of the condensed phosphate/orthophosphate builder mixture in a ratio by weight of condensed phosphate to orthophosphate of from 10:1 to 1:60, preferably from 5:1 to 1;30 and particularly from 1:1 to 1:30.

Any manganese (II) salt can in principle be employed, such as for example manganous sulphate ($Mn.SO_4$), either in its anhydrous form or as hydrated salt, manganous chloride ($MnC1_2$), anhydrous or hydrated, and the like.

The detergent bleach composition of the invention usually contains a surface active agent, generally in an amount of from about 2% to 50% by weight, preferably from 5–30% by weight. The surface active agent can be anionic, nonionic, zwitterionic or cationic in nature or mixtures of such agents.

Preferred anionic non-soap surfactants are watersoluble salts of alkylbenzene sulphonate, alkyl sulphate, alkylpolyethoxyether sulphate, paraffin sulphonate, alpha-olefin sulphonate, alpha-sulfocarboxylates and their esters, alkylglycerylethersulphonate, fatty acid monoglyceride-sulphates and -sulphonates, alkylphenolpolyethoxy ethersulphate, 2-acyloxy-alkane1-sulphonate, and beta-alkyloxy alkanesulphonate. Soaps are also preferred anionic surfactants.

Especially preferred are alkylbenzenesulphonates with about 9 to about 15 carbon atoms in a linear or branched alkyl chain, more especially about 11 to about 13 carbon atoms; alkylsulphates with about 8 to about 22 carbon atoms in the alkyl chain, more especially from about 12 to about 18 carbon atoms; alkylpolyethoxy ethersulphates with about 10 to about 18 carbon atoms in the alkyl chain and an average of about 1 to about 12 —$CH_2CH_2O$-groups per molecule, especially about 10 to about 16 carbon atoms in the alkyl chain and an average of about 1 to about 6 —$CH_2CH_2O$-groups per molecule; linear paraffin sulphonates with about 8 to about 24 carbon atoms, more especially from about 14 to about 18 carbon atoms and alpha-olefin sulphonates with about 10 to about 24 carbons atoms, more especially about 14 to about 16 carbon atoms; and soaps having from 8 to 24, especially 12 to 18 carbon atoms.

Water-solubility can be achieved by using alkali metal, ammonium, or alkanolamine cations; sodium is preferred. Magnesium and calcium may be preferred cations under circumstances described by Belgian Pat. No. 843 636.

Preferred nonionic surfactants are water-soluble compounds produced by the condensation of ethylene oxide with a hydrophobic compound such as an alcohol, alkyl phenol, polypropoxy glycol, or polypropoxy ethylene diamine.

Especially preferred polyethoxy alcohols are the condensation product of 1 to 30 moles of ethylene oxide with 1 mol of branched or straight chain, primary or secondary aliphatic alcohol having from about 8 to about 22 carbon atoms; more especially 1 to 6 moles of ethylene oxide condensed with 1 mol of straight or branched chain, primary or secondary aliphatic alcohol having from about 10 to about 16 carbon atoms; certain species of poly-ethoxy alcohol are commercially available under the trade-names of "Neodol" ®, "Synperonic" ®and "Tergitol" ®.

Preferred zwitterionic surfactants are water-soluble derivatives of aliphatic quaternary ammonium, phosphonium and sulphonium cationic compounds in which the aliphatic moieties can be straight or branched, and wherein one of the aliphatic substituents contains from about 8 to 18 carbon atoms and one contains an anionic water-solubilizing group, especially alkyldimethylpropanesulphonates and alkyldimethyl-ammoniohydroxypropane-sulphonates wherein the alkyl group in both types contains from about 1 to 18 carbon atoms.

Preferred cationic surface active agents include the quaternary ammonium compounds, e.g. cetyltrimethylammonium-bromide or -chloride and distearyldimethylammonium-bromide or -chloride, and the fatty alkyl amines.

A typical listing of the classes and species of surfactants useful in this invention appear in the books "Surface Active Agents", Vol. I, by Schwartz & Perry (Interscience 1949) and "Surface Active Agents", Vol. 11 by Schwarz, Perry and Berch (Interscience 1958), the disclosures of which are incorporated herein by reference. The listing, and the foregoing recitation of specific surfactant compounds and mixtures which can be used in the specific surfactant compounds and mixtures which can be used in the instant compositions, are representative but are not intended to be limiting.

In addition thereto the compositions of the invention may contain any of the conventional components and/or adjuncts usable in fabric washing compositions.

As such can be named, for instance, other conventional or non-conventional detergency builders, inorganic or organic, which can be used together with the builder mixture of the invention up to a total builder level of about 80% by weight.

Examples of suitable other inorganic builders are borates and silicates. Specific examples of such salts are sodium and potassium tetraborates, metaborates and silicates. Examples of organic builders are alkylmalonates, alkylsuccinates, nitrilotriacetates and carboxymethyloxymalonates.

Other components/adjuncts commonly used in detergent compositions are for example soil-suspending or antideposition agents such as the water-soluble salts of carboxymethylcellulose, carboxyhydroxymethylcellulose, copolymers of maleic anhydride and vinyl ethers, and polyethylene glycols having a molecular weight of about 400 to 10,000. These can be used at levels of about 0.5% to about 10% by weight. Dyes, pigments, optical brighteners, perfumes, anti-caking agents, suds control agents and fillers can also be added in varying amounts as desired.

The detergent compositions of the invention are preferbly presented in free-flowing particulate, e.g. powdered or granular form, and can be produced by any of the techniques commonly employed in the manufacture of such detergent compositions, but preferably by slurrymaking and spray-drying processes to form a detergent base powder to which the heat-sensitive ingredients, including the peroxide compound and optionally some other ingredients as desired, are added. It is preferred that the process used to form the compositions should result in a product having a moisture content of not more than about 12%, more preferably from about 4% to about 10% by weight. The manganese compound may be added to the compositions as part of the aqueous slurry, which is then dried to a particulate detergent powder, or as a dry substance mixed in with the detergent base powder.

One major advantage of the present invention is that effective bleach improvement at substantially all temperatures is independent of specially selected chelating agents as proposed in the art.

Furthermore the manganese (II)/mixed builder system of the invention is an effective all-temperature catalyst for peroxide compounds, showing minimal wasteful solution decomposition.

EXAMPLE I

The following particulate detergent compositions were prepared at varying ratios of sodium triphosphate (STP) to sodium orthophosphate (TSOP):

| Composition (% by weight) | A | B | C |
|---|---|---|---|
| Sodium $C_{12}$ alkylbenzene-sulphonate | 15.0 | 15.0 | 15.0 |
| Sodium triphosphate/trisodium-orthophosphate | 30.0 | 30.0 | 30.0 |
| Sodium perborate tetrahydrate | 25.0 | 25.0 | 25.0 |
| Manganous sulphate (% as $Mn^{2+}$) | 0.2 | 0.1 | — |
| Sodium sulphate + water up to 100% | | | |

These compositions were tested at a dosage of 5 g/1 in a 30 minute isothermal wash at 40° C. in 24° H. water.

The bleaching effects obtained on tea-stained test cloths measured as Δ R (reflectance) were as follows:

TABLE I

| % STP | % TSOP | Δ R A | Δ R B | Δ R C |
|---|---|---|---|---|
| (a) 30 | 0 | 4 | — | 2.7 |
| (b) 25 | 5 | 6.5 | — | 3.5 |
| (c) 20 | 10 | 9.0 | — | 4.2 |
| (d) 15 | 15 | 11.2 | — | 5.2 |
| (e) 10 | 20 | 13.5 | 12.0 | 6.8 |
| (f) 5 | 25 | 13.0 | 15.3 | 8.6 |
| (g) 2 | 28 | 10.5 | 15.3 | 8.0 |
| (h) 0 | 30 | 5.3 | — | 7.5 |

Compositions A(b-g) and B(e-g) within the invention were clearly superior to compositions A(a), A(h) and C (a-h) outside the invention.

A significant improvement in bleaching effect at 40° C. has been achieved with compositions A(c-g) and B(e-g) over all other compositions outside the invention. Similar results were obtained if in the above formulations sodium pyrophosphate was used instead of STP.

EXAMPLE II

The following detergent compositions were prepared, containing a builder mixture of sodium pyrophosphate and sodium orthophosphate at varying ratios.

| Compositions | % by weight |
|---|---|
| Sodium $C_{12}$ alkylbenzene sulphonate | 15.0 |
| Sodium pyrophosphate/sodium orthophosphate | 30.0 |
| Sodium perborate tetrahydrate | 25.0 |
| Manganous sulphate (% as $Mn^{2+}$) | 0.04 |
| Sodium sulphate + water | up to 100 |

These compositions were tested at a dosage of 5 g/1 in a 30 minutes' isothermal wash at 40° C. in demineralized water.

The bleaching effects obtained on tea-stained test cloths, measured as Δ R (reflectance), were as follows (see Table II).

TABLE II

| % Pyro | % Ortho | Δ R (reflectance) +Mn | −Mn |
|---|---|---|---|
| 30 | 0 | 4 | 3 |
| 20 | 10 | 8.3 | 5 |
| 15 | 15 | 10.4 | 6.9 |
| 10 | 20 | 11.3 | 8.2 |
| 5 | 25 | 12.5 | 7.4 |

The above results show that even in demineralized water without $Ca^{2+}$ ions the effect of pyro/ortho mixtures is evident.

EXAMPLES III and IV

The following compositions were prepared:

| Compositions | % by weight |
|---|---|
| Sodium $C_{12}$ alkylbenzene sulphonate | 15.0 |
| Sodium triphosphate (sodium hexameta-phosphate) | 7.5 |
| Sodium orthophosphate (sodium ortho-phosphate | 7.5 |
| Sodium perborate tetrahydrate | 25.0 |
| Manganous chloride (% as $Mn^{2+}$) | 0.04 |
| Sodium sulphate + water | up to 100 |

The compositions were tested at a dosage of 5 g/1 in a heat-up-to-boil wash in a washing machine and the bleaching results on tea-stained test cloths were monitored as reflectance values (ΔR) and reported in Table III.

TABLE III

| | Δ R +Mn | Δ R −Mn | (Δ R) +Mn | (Δ R) −Mn |
|---|---|---|---|---|
| 30° C. | 0.44 | 0.08 | 0.19 | 0.28 |
| 40° C. | 1.15 | 0.57 | 0.24 | 0.61 |
| 50° C. | 4.29 | 1.58 | 2.49 | 1.47 |
| 60° C. | 7.74 | 4.97 | 6.78 | 5.50 |
| 70° C. | 12.64 | 10.32 | 11.00 | 9.59 |
| 80° C. | 16.47 | 15.34 | 15.44 | 14.39 |
| 90° C. | 23.84 | 20.55 | 21.83 | 19.01 |
| 95° C. | 28.73 | 27.12 | 29.73 | 27.23 |

I claim:

1. A built detergent bleach composition comprising from 2–50% by weight of a surface-active agent selected from anionic, nonionic, zwitterionic and cationic detergents and mixtures thereof; 4–50% by weight of a peroxide compound bleach; 5–80% by weight of a builder mixture comprising essentially a condensed phosphate and an alkalimetal orthophosphate in a weight ratio of from 10:1 to 1:60, and a manganese compound which delivers manganese (II) ions in aqueous solution, in an amount of 0.005 to 2.5% by weight as manganese (II) metal based on the total detergent composition.

2. A composition according to claim 1, wherein said manganese compound is a manganese (II) salt, selected from manganous sulphate and manganous chloride.

3. A composition according to claim 1, which contains 0.025 to 1.0% by weight of manganese (II) metal.

4. A composition according to claim 1, wherein the ratio by weight of condensed phosphate to alkalimetal orthophosphate is from 5:1 to 1:30.

5. A composition according to claim 4, wherein said condensed phosphate and alkalimetal orthophosphate are present in a weight ratio of from 1:1 to 1:30.

* * * * *